US006871607B2

(12) United States Patent
Trepanier

(10) Patent No.: US 6,871,607 B2
(45) Date of Patent: Mar. 29, 2005

(54) PONTOON WITH SHELL THEREFOR

(76) Inventor: Paul Trepanier, 204 ch du Grand Lac Long, Saint-Elie-de-Caxton, QBC (CA), G0X 2N0

( * ) Notice: Subject to any disclaimer, the term of this patent is extended or adjusted under 35 U.S.C. 154(b) by 0 days.

(21) Appl. No.: 10/688,985

(22) Filed: Oct. 21, 2003

(65) Prior Publication Data

US 2004/0079270 A1 Apr. 29, 2004

Related U.S. Application Data

(63) Continuation-in-part of application No. 10/231,118, filed on Aug. 30, 2002, now Pat. No. 6,786,165.

(51) Int. Cl.[7] ..... B63B 1/00
(52) U.S. Cl. ..... 114/61.1; 114/357
(58) Field of Search ..... 114/61.1, 357, 114/351, 352, 353

(56) References Cited

U.S. PATENT DOCUMENTS

| | | | | |
|---|---|---|---|---|
| 3,580,202 A | | 5/1971 | Thompson | |
| 3,752,102 A | | 8/1973 | Shuman | |
| 3,878,803 A | | 4/1975 | Leverton | |
| 4,365,577 A | | 12/1982 | Heinrich | |
| 4,386,441 A | * | 6/1983 | Lundholm | 14/27 |
| 4,777,898 A | | 10/1988 | Faulkner | |
| 4,993,350 A | | 2/1991 | Pepper | |
| 5,020,175 A | | 6/1991 | Kirkpatrick et al. | |
| 5,203,271 A | | 4/1993 | Chapman | |
| 5,520,561 A | | 5/1996 | Langenohl | |
| 5,540,169 A | * | 7/1996 | Davis et al. | 114/61.1 |
| 5,687,664 A | | 11/1997 | Sofian | |
| 5,732,649 A | | 3/1998 | Falcone | |
| 5,950,558 A | | 9/1999 | Strong | |
| 5,988,087 A | | 11/1999 | Pepper | |
| 6,021,730 A | | 2/2000 | Carey, II | |
| 6,035,797 A | | 3/2000 | Robinson | |
| 6,302,042 B1 | | 10/2001 | Biedenweg et al. | |

* cited by examiner

*Primary Examiner*—Stephen Avila

(57) ABSTRACT

A pontoon includes a generally elongated shell made of at least two shell segments assembled in an end-to-end configuration at adjacent male and female segment connecting ends. Each segment has a segment peripheral wall surrounding a segment inner volume. Each segment defines at least one end aperture extending into the segment inner volume from one of the segment longitudinal ends. The female segment connecting end is a longitudinal end portion of the segment peripheral wall. A filling component is positioned within the segment inner volumes. The filling component is made out of a buoyant material longitudinally and slidably inserted into the end apertures. The volume of the filling component into the shell is such that the combination of the shell and the filling component forms a buoyant combination. A mold for the fabrication of the shell segments is also disclosed.

27 Claims, 8 Drawing Sheets

PONTOON WITH SHELL THEREFOR

CROSS-REFERENCE TO RELATED APPLICATION

The present application is a Continuation-In-Part (C.I.P.) of corresponding U.S. patent application Ser. No. 10/231,118 filed on Aug. 30, 2002 now U.S Pat. No. 6,786,165 issued Sep. 7, 2004.

FIELD OF THE INVENTION

The present invention relates to the general field of floating accessories and is particularly concerned with a pontoon with a shell therefor.

BACKGROUND OF THE INVENTION

With the advent of the so-called leisure society and the concurrent trend towards outdoor activities, recreational facilities are being elaborated in areas where water is available. Such recreational facilities typically require docks and marinas so that boats can be used conveniently. Also, recreational crafts such as pontoon boats are becoming increasingly popular.

In constructing marinas or small boats harbors, it is typically desirable to use a floating wharf structure which is accessible from land and has one or more fingers extending out into the body of water. The floating platforms used for building marinas are sometimes also used with some modifications as diving platforms and the like.

Generally, floating platforms include an upper decking material supported by a series of transverse and longitudinal support members. Similarly, pontoon boats typically include a deck disposed over two lateral elongated pontoons. This type of construction may also be used with modifications in larger watercrafts such as ferries, scientific research vessels and the like where the stability of the craft in the water is important.

Various types of floating components have been used or proposed in the prior art for the construction of rafts, floating docks and other water buoyant structures. One particularly popular type of buoyant or floating component has been the empty barrel or drum. While the use of such barrels typically made out of steel or the like has been a useful expedient, this practice nevertheless suffers from numerous drawbacks.

Docks and other floating structures made with steel barrels are relatively heavy and quite difficult to put in and take out, of the water. Also, the steel of the barrels tends to rust and specially designed brackets are often needed to secure the barrels to the framework of the dock or raft.

Furthermore, the type of framework required with barrels is typically of a sizeable and expensive nature. Still furthermore, the decking is often supported at a greater height above the water than is desirable.

Foam-filled automobile tires have also been used as water-buoyant components. Although somewhat useful and providing for the recycling of used tires, they also suffer from numerous drawbacks, including the fact that they are relatively heavy.

They are also considered to be expensive relative to the amount of floatation capacity they provide. Rigid foam made out of expanded polystyrene or the like have also been used with limited success since the latter has a tendency to deteriorate over time and to flake off or break up into small particles. They further have a tendency to absorb water.

Another type of floating component commonly used for docks, rafts, pontoon boats and other floating structures is the so-called modular float or "pontoon". Such pontoons are typically divided into two types, namely those that are integral and have a hollow closed shell and those that are not integral and rely upon a closed-cell foam to provide the required positive buoyancy.

Upon installation in water, floating components such as pontoons must typically provide the ability to withstand the natural abuse of the environment such as moisture, exposure to gasoline and oils present in the water of a marina and weather conditions. The floating components must also have the ability to provide long term durability and easy maintenance and to be rodent- and crab-protected. Although most conventional prior art pontoons operate satisfactorily for the purpose intended, they nevertheless suffer from numerous drawbacks. For example, they are often considered unwieldy and expensive to construct.

Also, traditionally, pontoon logs included a generally hollow enclosure, with the air entrapped in the hollow enclosure providing the requisite buoyancy to maintain the structure afloat. In order to provide increased structural integrity to the material forming the hollow enclosure, billets of polystyrene foam have been inserted in the hollow enclosure in a generally T-shaped configuration extending the length of the pontoon log. The billets of polystyrene foam are buoyant and therefore provide some degree of floating in the event of a puncture of the material forming the hollow enclosure of the pontoon logs.

The polystyrene billets however do not prevent water from flooding the log interior through the puncture opening. The flooding of the interior of the pontoon log displaces the air therein and thereby significantly reduces the buoyancy of the pontoon log.

In order to reduce the influx of water into the pontoon log in the event it is punctured, the pontoon log may optionally be completely filled with floatation foam. While this construction provides the desired protection against influx of water into the pontoon interior in the event of a puncture, it may nevertheless suffers from several shortcomings. For example, when the foam is injected into the enclosure, the quantity of floatation foam required to completely fill the pontoon log interior adds considerable expense to the pontoon logs. Furthermore, some precautions are required to ensure the injected foam does not generate too much heat that could affect the integrity of the shell.

Indeed, a conventional method of manufacturing pontoons requiring closed-cell foam for positive buoyancy involves first manufacturing a generally parallelepiped-shaped rigid and hollow shell from a suitable polymeric resin such as high density polyethylene. The hollow shell is then filled with a closed-cell core by injecting a suitable polymeric resin such as expanded polystyrene foam thereinto. This method is both expensive and time consuming.

Furthermore, this prior art method makes it difficult to customize the amount of closed-cell foam within the shell depending on the desired buoyancy characteristics of the pontoon. Also, the prior art method makes it difficult to use existing components such as existing shell extrusions and existing core extrusions.

Other problems associated with prior art pontoons include a difficulty in assembling pontoons together or to decking structures. Also, prior art pontoons are particularly difficult to drag upon a solid surface, such as is often required when the pontoon is being dragged into or out of a body of water.

Furthermore, most prior art pontoons suffer from a lack of versatility in that they fail to provide a means for allowing the adjustment of the buoyancy and, hence, of the height of the structure they support relative to the body of water. Also, most prior art pontoons suffer from being unable to provide for stability-increasing features such as a balancing system.

SUMMARY OF THE INVENTION

Accordingly, there exists a need for both an improved pontoon structure with a shell therefor. It is therefore a general object of the present invention to provide an improved pontoon structure and a shell used in the fabrication thereof.

Advantages of the present invention include that the proposed pontoon may be used for providing floating support to a variety of floating structures including docks, marinas, water vessels and the like.

The proposed pontoon is adapted to provide a reliable structure able to withstand various environmental agents such as moisture, petroleum products and the like. The proposed structure is also intended to resist attacks by rodents and other animals. Furthermore, the proposed structure is intended to at least partially provide some degree of floatation in the event it is punctured.

The proposed pontoon is also designed so as to facilitate its attachment to adjacent pontoons and/or to other structures such as decks.

It is designed to be attachable to floating structures such as docks, pontoon boats and the like without requiring special tooling or manual dexterity through a set of quick, easy and ergonomic steps. Also, the proposed pontoon is adapted to provide long-time durability and ease of maintenance while being relatively easy to repair if damaged.

Furthermore, the proposed structure is designed so as to be relatively easily transported either to a launching site or in and out of the water once at the launching site. More specifically, the proposed pontoon is designed so as to reduce friction with a solid ground surface when the pontoon is being dragged into or out of a body of water.

Furthermore, the proposed pontoon is designed so as to be easily customizable with regards to the required positive buoyancy provided thereby. Optionally, the proposed pontoon may also be provided with balancing capabilities so as to improve the overall stability of the pontoon.

The proposed method of manufacturing the pontoon is intended to reduce overall manufacturing costs. Also, the proposed method may be readily performed through a set of quick and ergonomic steps without requiring special tooling or manual dexterity. More specifically, the shell can easily be customized in length by assembling a plurality of shell segments together. A common mold, preferably manufactured through a rotational molding process, could be used to manufacture all segments, each segment including different sections of the molded shell product.

Furthermore, the proposed method allows for the easy optional customization of both the buoyancy and balancing capabilities of the pontoon. Furthermore, the proposed method allows for recycling of existing extruded shells and extruded foam cores.

According to an aspect of the present invention, there is provided a pontoon, the pontoon comprises: a plurality of generally elongated shell segments, each the shell segment being made out of a generally rigid material, each the shell segment defining a pair of generally opposed segment longitudinal ends, at least one of the segment longitudinal ends being a segment connecting end; each the shell segment having a segment peripheral wall surrounding a segment inner volume and defining at least one end aperture extending into the segment inner volume from the segment connecting end, the plurality of shell segments connecting to each other with a male-female engagement into an end-to-end configuration so as to form a generally elongated shell, the shell defining a shell longitudinal axis extending through the plurality of shell segments, said male-female engagement including a male segment connecting end connectable to an adjacent female segment connecting end, said female segment connecting end being a longitudinal end portion of said segment peripheral wall; a filling component positioned within the segment inner volumes, the filling component being made out of a generally buoyant material, the filling component being slidably and successively insertable through the at least one end apertures in a direction generally along the shell longitudinal axis and towards corresponding the opposed segment longitudinal end, the volume of the filling component being such that the combination of the shell and the filling component forms a generally buoyant combination.

Typically, the male segment connecting end is formed by a throat section located at a longitudinal end portion of the segment peripheral wall Typically, the male segment connecting end is connectable to the adjacent female segment connecting end with a longitudinal sliding engagement.

In one embodiment, the pontoon further comprises a closing component mounted at least partially over the at least one end aperture of an end one of the shell segments for at least partially closing the at least one end aperture of the end one of the shell segments.

In one embodiment, the segment peripheral wall includes a base section, a generally opposed supporting section and a pair of spacing sections extending therebetween in a generally spaced apart relationship relative to each other; the base section defining a base section outer surface, the base section outer surface being provided with at least one longitudinal channel extending substantially and at least partially therealong.

In one embodiment, the segment peripheral wall includes a base section, a generally opposed supporting section and a pair of spacing sections extending therebetween in a generally spaced apart relationship relative to each other; the supporting section defining at least one linking flange extending laterally therefrom in a direction leading generally adjacent from an adjacent spacing section.

Typically, the spacing sections taper generally towards each other in a direction leading towards the base section.

In one embodiment, the segment inner volume defines a generally hollow ballast section extending at least partially longitudinally therealong; whereby the ballast section is at least partially fillable with a ballast material.

In one embodiment, the pontoon further comprises an end cap, the end cap including a cap wall for generally overriding the at least one end aperture of a longitudinal endmost of the shell segments.

Typically, the end cap further includes a cap flange extending from the cap wall for attaching the cap wall to the longitudinal endmost of the shell segments. The cap flange is preferably inserted into the segment inner volume between the longitudinal endmost of the shell segments and the filling component.

In one embodiment, the pontoon further comprises a cap valve extending through the cap wall for selectively establishing a fluid communication between the segment inner volumes and the exterior of the shell.

In one embodiment, the pontoon further comprises a valve extending between one of the segment inners volume and the exterior of the shell for selectively establishing a fluid communication between the segment inner volumes and the exterior of the shell.

In one embodiment, the pontoon further comprises a connecting component connecting said female segment connecting ends of adjacent shell segments to one another, said connecting component at least partially filling said segment inner volumes adjacent said segment peripheral walls at said female segment connecting ends.

Typically the connecting component defines a connector longitudinal axis, the connecting component having a connector peripheral wall surrounding a connector inner volume extending longitudinally therethrough, the connector inner volume being in fluid communication with the segment inner volumes of adjacent the shell segments, whereby the filling component is slidably and successively insertable through the connector inner volume and the adjacent segment inner volumes in a direction generally along the connector longitudinal axis and shell longitudinal axis, respectively.

Typically, the connector peripheral wall is configured and sized to longitudinally slidably fit into the segment inner volume of adjacent the shell segments.

Typically, the connector peripheral wall has a periphery generally smaller than the periphery of the segment peripheral wall of adjacent the shell segments so as to longitudinally slidably fit thereinto.

According to another aspect of the present invention, there is provided a shell for pontoon, the shell comprises a generally elongated shell segment being made out of a generally rigid material, the shell segment defining a shell longitudinal axis, the shell segment having a segment peripheral wall extending between a pair of generally opposed longitudinal segment closing ends and surrounding a shell inner volume, said shell segment having a longitudinal throat section located intermediate said segment closing ends, the shell segment being dividable in a direction generally transverse to the shell longitudinal axis at a location adjacent said throat section into at least two longitudinal sections with a respective end aperture extending into respective the shell inner volume so as to allow the shell inner volumes to be at least partially fillable by a filling component.

Typically, the segment peripheral wall of the throat section is configured and sized to be longitudinally and slidably fittable into the shell inner volume of the remaining section of the shell segment.

Typically, the throat section extends longitudinally inwardly from one of the longitudinal segment closing ends.

Typically, the shell segment defines a first predetermined transversal dividing region at an interface between the throat section and a remaining portion of the shell segment.

Typically, the shell segment defines a second predetermined transversal dividing region at an interface between the throat section and the one of the longitudinal segment closing ends.

In one embodiment, the segment peripheral wall includes a base section, a generally opposed supporting section and a pair of spacing sections extending therebetween in a generally spaced apart relationship relative to each other; the base section defining a base section outer surface, the base section outer surface being provided with at least one longitudinal channel extending substantially and at least partially therealong.

In one embodiment, the segment peripheral wall includes a base section, a generally opposed supporting section and a pair of spacing sections extending therebetween in a generally spaced apart relationship relative to each other; the supporting section defining at least one linking flange extending laterally therefrom in a direction leading generally adjacent from an adjacent spacing section.

Typically, the spacing sections taper generally towards each other in a direction leading towards the base section.

In one embodiment, the shell is manufactured using a rotational molding process.

Typically, at least one of the generally opposed longitudinal segment closing ends has a generally hydrodynamically convex configuration.

Other objects and advantages of the present invention will become apparent from a careful reading of the detailed description provided herein, within appropriate reference to the accompanying drawings.

BRIEF DESCRIPTION OF THE DRAWINGS

Embodiments of the invention will now be disclosed, by way of example, in reference to the following drawings in which.

DETAILED DESCRIPTION OF THE PREFERRED EMBODIMENTS

Figure 1:
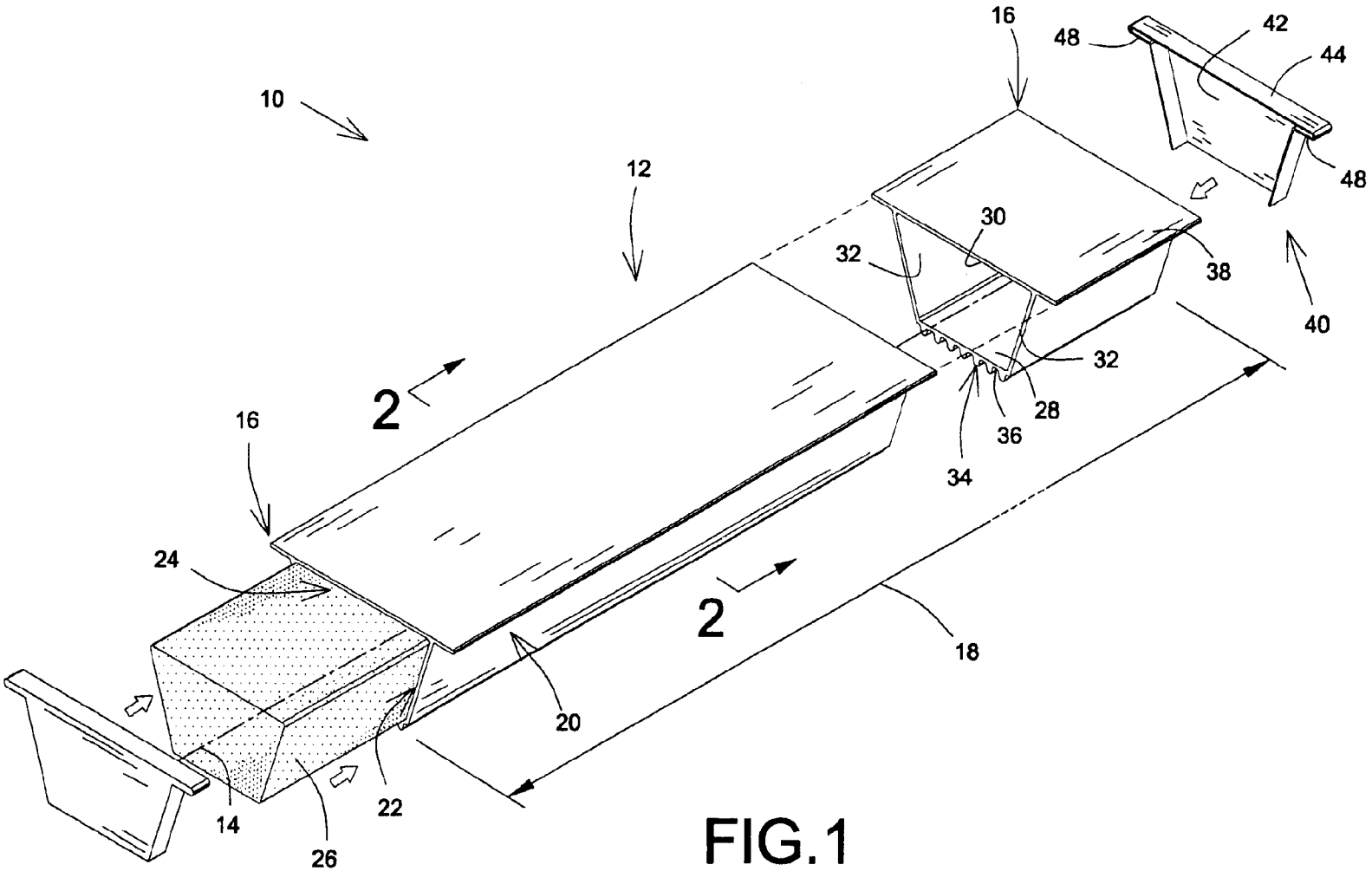
FIG. 1, in a partial perspective view, with sections taken out, illustrates a pontoon in accordance with an embodiment of the present invention.

Referring to FIG. 1, there is shown a pontoon 10, in accordance with an embodiment of the present invention.

The pontoon 10 includes a generally elongated shell 12. The shell 12 defines a shell longitudinal axis 14, a pair of generally opposed shell longitudinal ends 16 and a shell length 18 extending along the shell longitudinal axis 14 between the shell longitudinal ends 16.

The shell 12 has a shell peripheral wall 20 surrounding a shell inner volume 22. The shell peripheral wall 20 defines at least one end aperture 24 extending into the shell inner volume 22 from one of the shell longitudinal ends 16. Typically, as illustrated throughout the figures, the shell peripheral wall 20 defines a pair of opposed end apertures 24 (only one of which is shown in FIG. 1) both extending into the shell inner volume 22 from opposed shell longitudinal ends 16. Alternatively, the shell peripheral wall 20 may define a single end aperture 24, the opposed section of the shell peripheral wall 20 being sealed-off.

The pontoon 10 also includes a filling component 26 positioned within the shell inner volume 22. The filling component 26 is configured and sized so as to be slidably insertable into at least one and preferably both of the end apertures 24. The filling component is insertable in a direction generally along the shell longitudinal axis 14 and towards an opposed shell longitudinal end 16. Typically, the filling component 26 is insertable from both shell longitudinal ends 16. Alternatively, it may be insertable from only one of the shell longitudinal ends 16.

The filling component 26 is made out of a generally buoyant material. The volume of the filling component 26 inserted within the shell inner volume 22 is such that the combination of the shell 12 and the filling component 26 inserted therein forms a generally buoyant combination.

Typically, although by no means exclusively, the shell peripheral wall 20 includes a base section 28, a generally opposed supporting section 30 and a pair of spacing sections 32 extending therebetween in a generally spaced apart relationship to each other. Typically, although by no means exclusively, the spacing sections 32 taper generally toward each other in a direction leading from the supporting section 30 towards the base section 28.

Typically, although by no means exclusively, the shell peripheral wall 20 hence has a generally trapezoidal cross-sectional configuration. It should be understood that the shell peripheral wall 20 could define other cross-sectional configurations without departing from the scope of the present invention as long as it defines a shell inner volume 22 having at least one shell end aperture 24 allowing slidable insertion of at least a portion of the filling component 26 thereinto.

The base section 28 defines a base section outer surface 34. In at least one embodiment of the invention, the base section outer surface 24 is provided with at least one longitudinal channel 36 extending at least partially therealong. Typically, the base section outer surface 34 is provided with a plurality of base longitudinal channels 36 extending therealong in a generally parallel relationship relative to each other. The base longitudinal channels 36 typically extend along the full length of the base section outer surface 34 although they could extend only partially therealong or extend in interrupted longitudinal segments.

In at least one embodiment of the invention, the supporting section 30 defines at least one linking flange 38 extending generally outwardly therefrom in a direction leading generally away from an adjacent spacing section 32. Typically, as illustrated in FIG. 1, the supporting section 30 is provided with a pair of linking flanges 38 extending from opposite sides thereof.

Although the linking flanges 38 are shown as being generally continuous, they could be formed out of interrupted flange segments without department from the scope of the present invention. Also, they could have any suitable cross-sectional configuration without departing from the scope of the present invention.

The pontoon 10 typically further includes a closing component 40 mounted at least partially over an end aperture 24 for at least partially closing the latter. Typically, in situations wherein the pontoon 10 defines a pair of end apertures 24, the pontoon 10 is provided with a corresponding pair of closing components 40. Also, typically, each closing component 40 is configured and sized for completely closing a corresponding end aperture 24.

Figure 5:
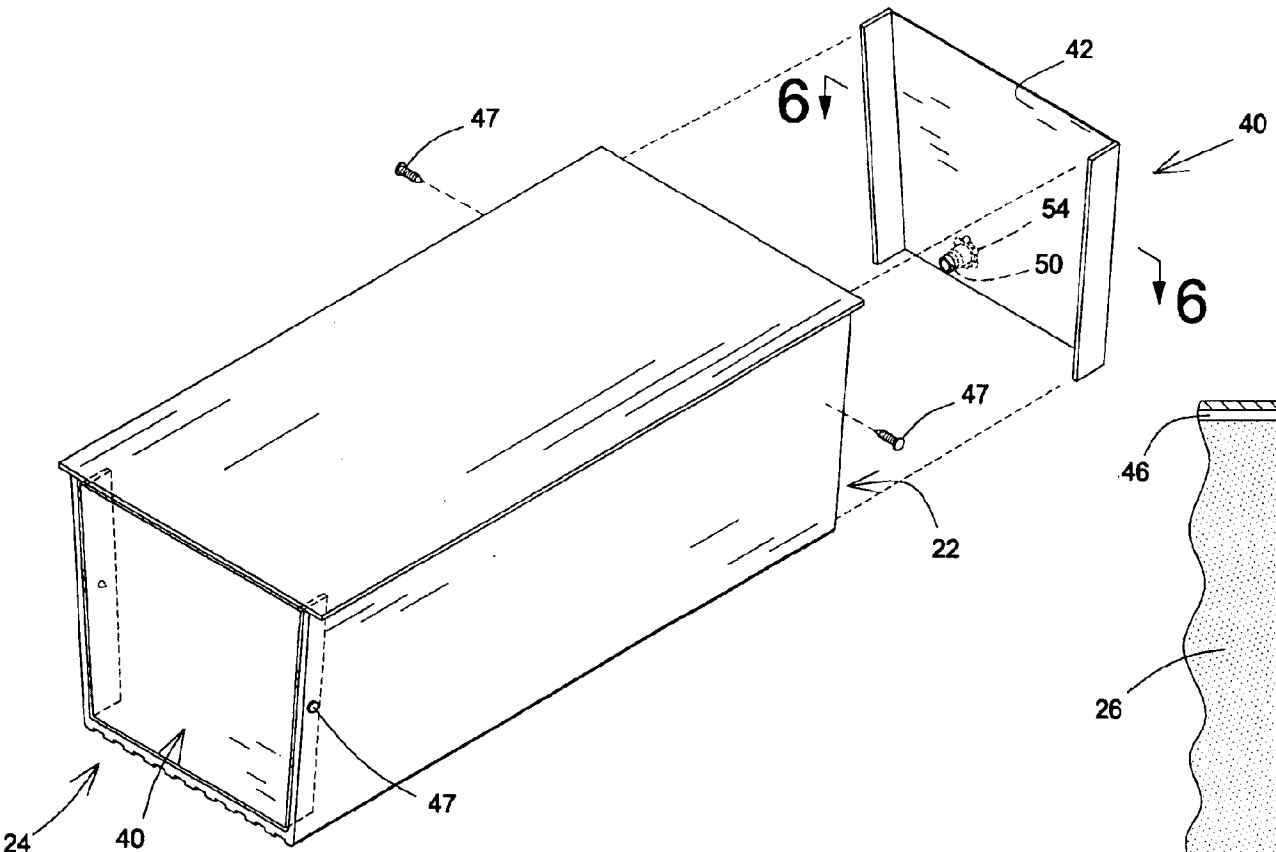
FIG. 5, in a perspective view with sections taken out, illustrates a shell component and an end cap in accordance with part of a pontoon in accordance with an embodiment of the invention.

Each closing component 40 includes an end cap having a cap wall 42 for generally overriding a corresponding end aperture 24 and a cap flange 44 extending therefrom for attaching the cap wall 42 over the corresponding end aperture 24. In the embodiment of the invention shown in FIGS. 5 and 6, the cap flange 44 is configured and sized so as to be substantially fittingly insertable into the corresponding end aperture 24.

The cap flange 44 is also configured and sized so as to be positioned in an intermediate location between the filling component 26 and an inner surface 46 of the shell peripheral wall 20. When such a configuration is used, at least a portion, and preferably most of the cap flange 44, is configured and sized so as to be frictionally retained within the corresponding end aperture 24 by a frictional contact with the filling component 26 and/or the inner surface 46 of the shell peripheral wall 20 or releasably secured thereto using conventional fasteners 47 such as screws or the like as illustrated in FIG. 6.

Alternatively, as illustrated in FIG. 1, the cap flange 44 may be configured and sized so as to override the segment of the outer surface of the shell peripheral 20 either in frictional contact therewith or using similar fasteners (not shown). Typically, in such situations, the flange 44 bends integrally so as to define a pair of flange channels 48 configured and sized for substantially fittingly receiving a corresponding segment of the linking flanges 38. It should be understood that the closing component 40 can take any suitable configuration without departing from the scope of the present invention.

Figures 3, 4:
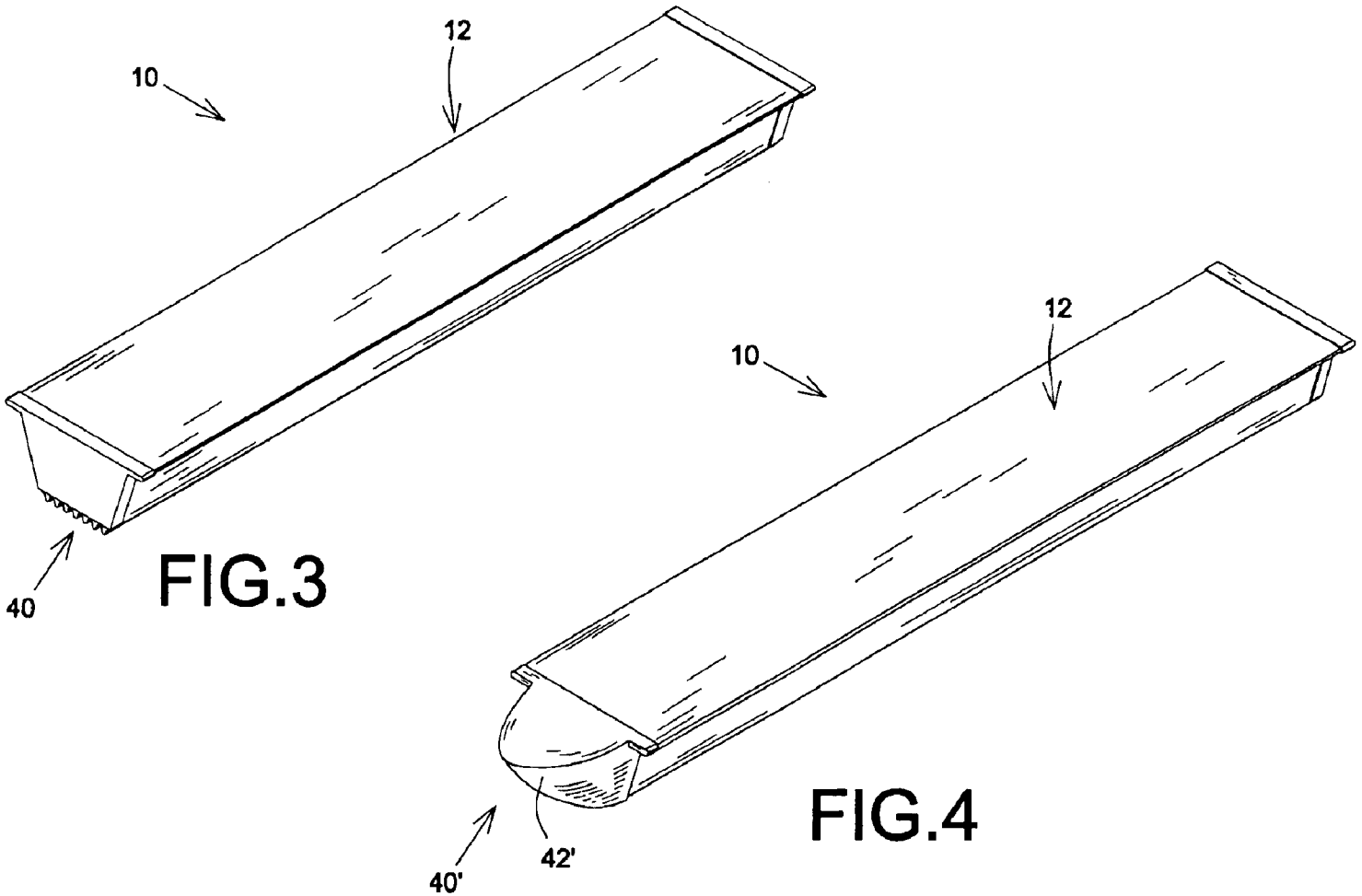
FIG. 3, in a perspective view, illustrates a pontoon in accordance with an embodiment of the present invention.
FIG. 4, in a perspective view, illustrates a pontoon in accordance with an alternate embodiment of the present invention.

As illustrated in FIG. 3, the cap wall 42 may have a generally flat configuration. FIG. 4 shows an alternative embodiment of the closing component 40' of the invention wherein the cap wall 42' has a generally hydrodynamically convex configuration for facilitating movement of the pontoon 10 on a body of liquid in a direction along the shell longitudinal axis 14. It should be understood that other types of convex and generally hydrodynamical configurations of the cap wall 42' could be used without departing from the scope of the present invention.

Figure 6:
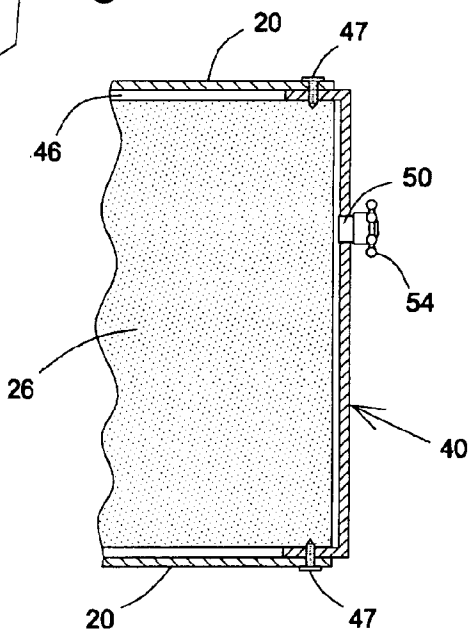
FIG. 6, in a partial longitudinal cross-sectional view, illustrates the relationship between some of the components of a pontoon in accordance with an embodiment of the present invention.

As illustrated more specifically in FIG. 6, the closing component 40 may optionally be provided with a valve 50 extending thereacross for selectively establishing a fluid communication between the shell inner volume 22 and the exterior 52 of the pontoon 10. Although the valve 50 is shown as extending through the closing component 40, it could extend through the shell peripheral wall 20 without departing from the scope of the present invention.

Also, although the valve 50 is illustrated schematically as being provided with a valve handle 54 for allowing an intended user to manually operate the valve 50, the valve 50 could be provided with one-way regulating mechanisms such as a ball mechanism or any suitable type of mechanism without departing from the scope of the present invention. In fact, the valve 50 may take any suitable form without departing from the scope of the present invention.

Figure 7:
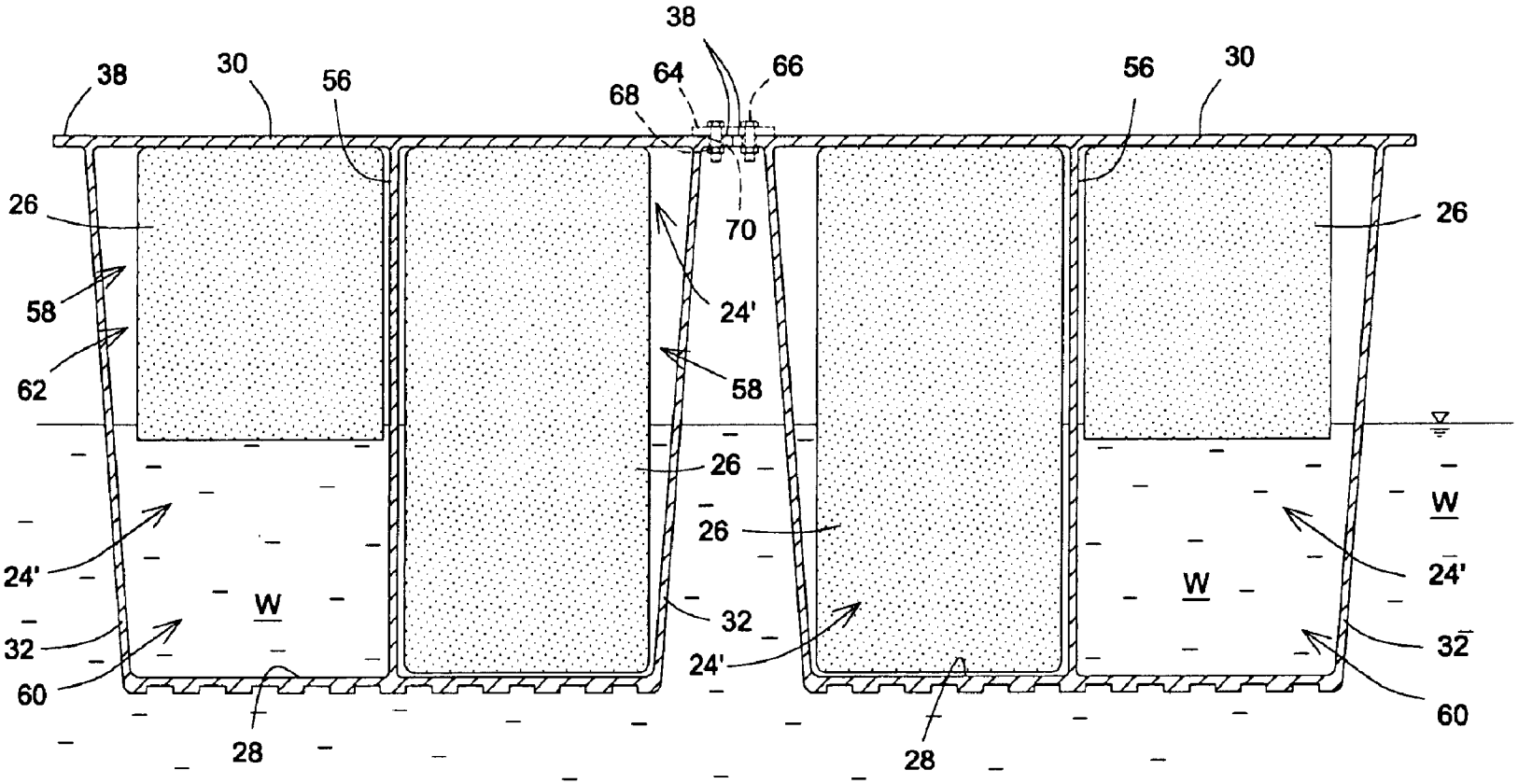
FIG. 7, in a transversal cross-sectional view, illustrates a pair of pontoons in accordance with an alternative embodiment of the present invention being assembled together FIG. 8, in an exploded perspective view, illustrates a pontoon in accordance with another embodiment of the present invention.

As illustrated more specifically in FIG. 7, the pontoon 10 may optionally further include a dividing wall 56 extending typically generally transversally across the shell inner volume 22. The dividing wall 56 is provided for dividing the shell inner volume 22 into at least a pair of shell sections 58 extending at least partially longitudinally therealong.

Although the dividing walls 56 are shown as extending between inner surfaces of the base and supporting sections 28, 30 in a generally perpendicular relationship relative thereto in FIG. 7, it should be understood that the dividing walls 56 could extend in other orientations without departing from the scope of the present invention. In the embodiment shown in FIG. 7, the dividing wall 56 as well as the filling component 26 extending generally fully from the base section 28 to the supporting section 30 further increase the rigidity of the shell 12 and the pontoon 10 in the general supporting direction leading from the base section 28 to the supporting section 30, rigidity required especially when the pontoon 10 is stored on ground or the like in a non-floating condition.

Also, the dividing walls 56 may extend only partially along the length 18 of the shell 12 and only partially across the shell air volume 22 without departing from the scope of the present invention. Furthermore, although FIG. 7 illustrates a shell inner volume divided in two shell sections 58, it should be understood that any suitable number of shell sections 58 could be formed within the shell inner volume 22 without departing from the scope of the present invention.

Each shell section 58 typically defines at least one corresponding end aperture 24' leading thereinto. Typically, each shell section 58 defines a corresponding pair of end apertures 24' leading thereinto from opposite shell longitudinal ends 16.

At least one of the shell sections 58 is at least partially filled with a corresponding filling component 26. In the embodiment shown in FIG. 7, the pontoon 10 includes two cooperating pieces of filling component 26.

Each cooperating piece of filling component 26 is slidably insertable into the shell inner volume 22 by slidable insertion into the corresponding one of the end apertures 24' in a direction generally along the shell longitudinal axis 14 and towards the opposed shell longitudinal end 16. Hence, each shell section 58 is typically at least partially filled with a corresponding filling component 26, the shell 12 and filling components 26 inserted therein forming a generally buoyant combination.

As illustrated more specifically in FIG. 7, in at least one embodiment of the invention, at least one of the shell sections 58 defines a generally hollow ballast section 60. The ballast section 60 is designed so as to be at least partially fillable with a ballast material. Typically, although by no means exclusively, the ballast material is a fluid such as water W. It should be understood that any suitable number of shell sections 58 could be provided with a corresponding ballast section 60. Also, the ballast section 60 can be filled only partially or, alternatively, completely with any suitable ballast material to enable the ballast section 60 to act as a suitable ballast for the pontoon 10.

Typically, as illustrated in FIG. 7, the shell section 58 provided with a ballast section 60 is also provided with a filling component receiving section 62 for receiving a corresponding filling component 26. The filling component receiving section 62 is typically positioned generally adjacent the inner surface of the support section 30 and, hence, in a generally overlying relationship relative to the ballast section 60. In such situations, the pontoon 10 is typically provided with a retaining means extending from the shell peripheral wall 20 for retaining the filling component 26 in a generally overlying relationship relative to the ballast section 60.

In one embodiment of the invention, the retaining means includes having the spacing sections 32 taper inwardly towards the base section 28 while the filling component 26 is configured and sized so as to abuttingly contact the inner surface of a corresponding spacing sections 32 upon reaching a predetermined spaced relationship relative to the base section 28.

Figure 2:
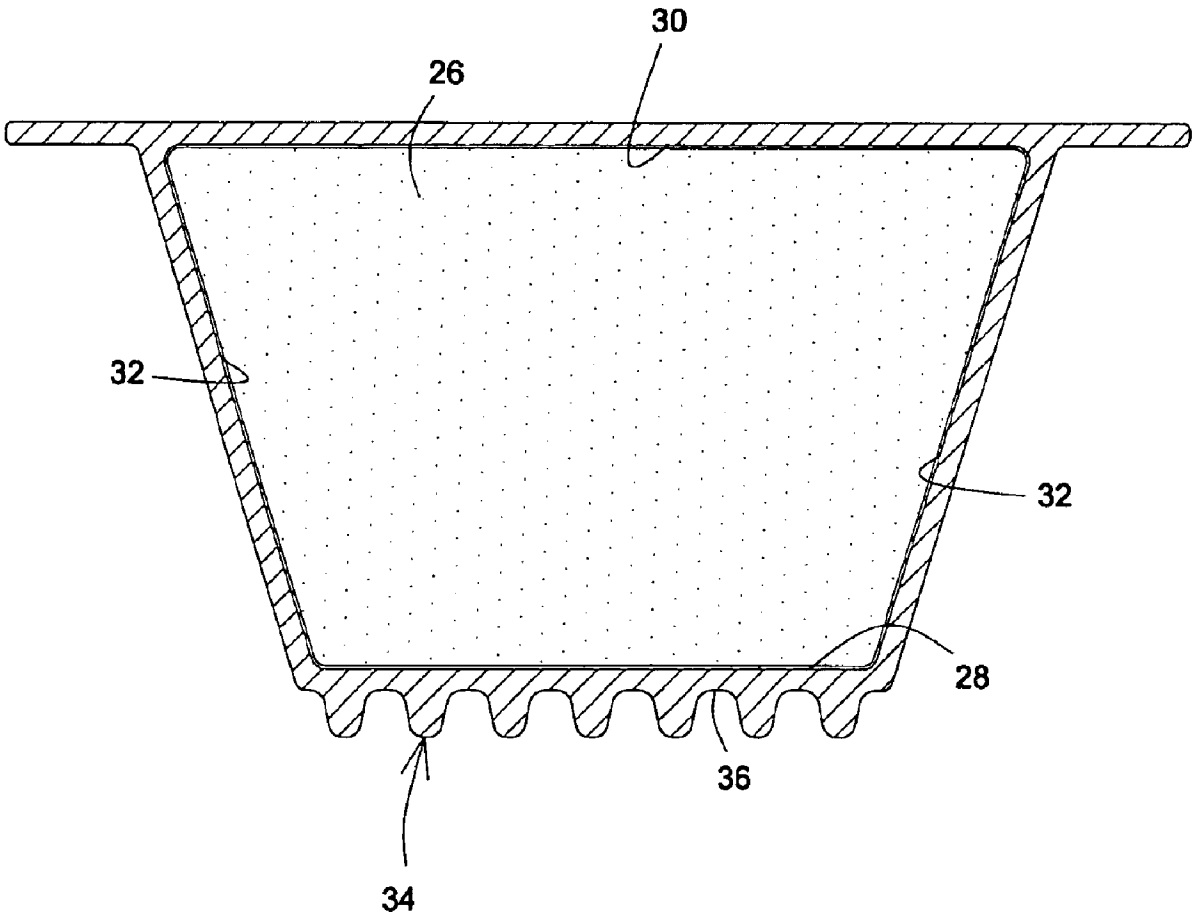
FIG. 2, in a transversal cross-sectional view taken along arrows 2—2 of FIG. 1, illustrates the cross-sectional configuration of the pontoon shown in FIG. 1.

In the embodiment shown in FIGS. 1 and 2, the filling component 26 has a generally trapezoidal cross-sectional configuration in order to substantially conform to the cross-sectional configuration of the inner surface of the shell peripheral wall 20 and is sized so as to be substantially fitted therein. In the embodiment shown in FIG. 7, the filling component 26 has a generally parallelepiped or rectangular cross-sectional configuration. It should be understood that other types of retaining means could be used without departing from the scope of the present invention. For example, inwardly-oriented inner flanges could extend from the inner surface of either or both spacing sections 32 and a corresponding dividing wall 56.

Also, it should be understood that the filling components 26 could have any suitable configuration without departing from the scope of the present invention. Furthermore, optionally, the ballast section 60 could be positioned between a pair of corresponding filling components 26 within the same shell section 58. Also, each shell section 58 could be provided with a plurality of corresponding ballast sections 60 and shell receiving sections 62 strategically positioned so as to obtain specific floating characteristics. The ballast section 60 could also be separated from adjacent filling component receiving sections 62 by section-separating walls (not shown).

Each pontoon 10 may optionally further be provided with a pontoon attachment means attached thereto for attaching a pontoon 10 to an adjacent similar pontoon 10' or any other structure such as a deck 64 or the like. The pontoon attachment means typically includes conventional fastening means such as bolts 66, and nuts 68 extending through corresponding attachment apertures 70 formed in at least one linking flange 38.

Both the shell 12 and the filling component 26 are typically manufactured through an extrusion manufacturing process. The shell 12 is typically made out of a self-supporting material such as a suitable polymeric resin.

Alternatively, the shell 12 could be made out of a generally deformable material forming a generally self-supporting structure only when the filling component 26 is inserted therein. In at least one embodiment of the invention, the shell 12 is made out of a generally rigid and moisture-resistant material such as polyvinyl chloride (PVC).

The filling component 26 is typically made out of a generally cohesive material. In at least one embodiment of the invention, the filling component 26 is made out of a generally self-supporting material.

Alternatively, the filling component 26 could be made out of a generally deformable material forming a self-supporting combination only once inserted into a corresponding shell 12. In at least one embodiment of the invention, the filling component 26 is made out of a closed-cell extruded polystyrene material.

In use, each pontoon 10 may be positioned in a body of liquid such as water for floating thereunto. The pontoon 10 is typically positioned with the base section 28 inserted into the body of water and the supporting section 30 protruding from the body of water, with the surface of the body of water located intermediate the base and supporting sections 28. The volume of buoyant components 26 is to be calibrated so as to provide suitable buoyancy for the intended need. When a ballast section 60 is provided, the latter is filled with a suitable ballast fluid, such as water, to enhance the stability of the pontoon 10 floating at the surface of the body of liquid.

The ballast section 60 may be filled and emptied when needed with the use of the valve 50. Alternatively, the ballast section 60 could be easily filled and/or emptied by removing at least one of the closing components 40.

The combination of the shell peripheral wall 20 and the closing components 40 typically form a generally rigid enclosure. The closing components 40 not only prevent unwanted slidable withdrawal of the filling components 26 from the shell inner volume 22 but also prevent animals such as small rodents from damaging the filling components 26. The closing components 40 preferably allow water W from the body of water to freely partially fill the intermediate location between the filling component 26 and the inner surface 46 of the shell peripheral wall 20 and/or any ballast section 60 of the shell inner volume 22.

When needed, a pontoon 10 may be attached to an adjacent similar or otherwise-shaped pontoon 10 using the linking flanges 38. The pontoon 10 may also be used together with other structures such as a deck 64 for providing a docking assembly.

The base channels 36 not only provide added structural rigidity but also reduce friction between the pontoon 10 and a supporting surface when the pontoon 10 is being dragged across a solid surface such as when it is being transported into and out of the body of water.

The present invention also relates to a method for manufacturing pontoons such as the pontoon generally designated by the reference numeral 10. The method includes the step of providing a generally elongated shell 12. The shell 12 defines a shell longitudinal axis 14 and a pair of generally opposed shell longitudinal ends 16. The shell also defines a shell length 18 extending along the shell longitudinal axis 14 between the shell longitudinal ends 16.

The provided shell 12 has a shell peripheral wall 20 surrounding a shell inner volume 22. The provided shell 12 also defines at least one shell end aperture 24 extending into the shell inner volume 22 from one of the shell longitudinal ends 16.

The method also includes the step of providing a filling component such as filling component 26 made out of a generally buoyant material. The filling component 26 and the shell 12 are configured and sized so that the filling component 26 may be slideably insertable into the shell 12.

The method further includes the step of at least partially filling the shell 12 with the filling component 26 until the shell 12 and the filling component 26 inserted therein form a generally buoyant combination. The filling component 26 is inserted into the shell inner volume 22 by slidably inserting the buoyant component 26 into and end aperture 16 thereof in a direction generally along the shell longitudinal axis 14 and towards the opposed shell longitudinal end 16.

In at least one embodiment of the invention, the step of providing the shell 12 includes manufacturing the shell 12 through an extrusion manufacturing process. Typically, the filling component 26 is provided also by manufacturing the latter through an extrusion manufacturing process. Hence, typically, both the shell 12 and the filling component 26 are provided by manufacturing the latter through corresponding extrusion manufacturing processes.

The method optionally further includes the step of at least partially closing at least one of the end apertures 24. The step of at least partially closing one of the end apertures 24 typically includes the step of providing an end cap 40 and mounting the latter in a generally overlying relationship relative to the corresponding end aperture 24.

Typically, the filling component 26 is made out of a generally cohesive material fragmentable into segments of filling components. In such situations, the method further includes the steps of evaluating the shell length 18 and fragmenting an initial piece of filling component into at least two fragmented filling components 26 so that at least one of the fragmented filling components 26 forms a buoyant combination with the shell 12 when inserted thereinto.

In other words, during the manufacturing process, the shell 12 may be provided at a predetermined shell length 18 and the filling component 26 inserted thereinto may be formed by fragmenting a longer initial piece of filling component 26 into a fragment suitable for insertion into the shell 12. The initial piece of filling component 26 may be fragmented using several manufacturing processes such as bending until breakage occurs or by using a suitable cutting tool.

During the manufacturing process, the initial piece of filling component 26 may be severed prior to being inserted into the shell inner volume 22. Alternatively, the initial piece of filling component 26 may be inserted into the shell inner volume 22 with a section thereof protruding outwardly from one of the end apertures 24. The initial piece of filling component 26 may be severed about its protruding section only once at least a section of the initial piece of filling component 26 has been inserted into the shell inner volume 22. In such situations, the shell 12 can be used as a guide for cutting the filling component 26 to the required length.

The filling component 26 may be severed or cut in a direction generally perpendicular to the longitudinal axis of the initial filling component 26. Alternatively, the filling component 26 may be cut in a direction parallel to the filling component longitudinal axis 14 or at an angle relative thereto.

In an alternative method of manufacturing, the method includes the steps of providing at least two cooperating pieces of filling component 26 cooperating in forming a sub-combination of filling component such that the sub-combination forms a buoyant combination with the shell when inserted thereinto. In such situations, the manufacturing process further includes the step of inserting the sub-combination of filling component 26 into the shell inner volume 22. In other words, instead of cutting segments of filling component 26 to be inserted into the shell 12, pre-cut sections of filling component 26 may be inserted into the shell 12 hence allowing for recycling of already cut segments of filling component 26.

The provided shell 12 may optionally define at least a pair of shell sections 58 extending at least partially and generally longitudinally therealong. Each shell section 58 is typically provided with at least one end aperture 24' leading thereinto. In such situations, the method may optionally further include the step of providing at least a pair of filling components 26 slidably insertable into a corresponding one of the shell sections 58. The method also includes the step of least partially filling each of the shell sections 58 with a corresponding one of the filling components 26 until the combination of the shell 12 and the filling component 26 inserted therein form a generally buoyant combination.

The filling components 26 are inserted into the shell inner volume 22 by slidably inserting the filling components 26 into a corresponding one of the at least one end aperture(s) 24' in a direction generally along the shell longitudinal axis 14 and towards the opposed shell longitudinal end 16.

Optionally, the method includes only partially filling a predetermined shell section 58 with a corresponding filling component 26 so as to define a ballast portion 60. The ballast portion 60 being fillable with a ballast material such as water. In such instances, the method may further include the step of filling the ballast portion 60 with a ballast material to improve the stability of the pontoon 10 floating at the surface of the body of liquid it is used in.

Figure 8:
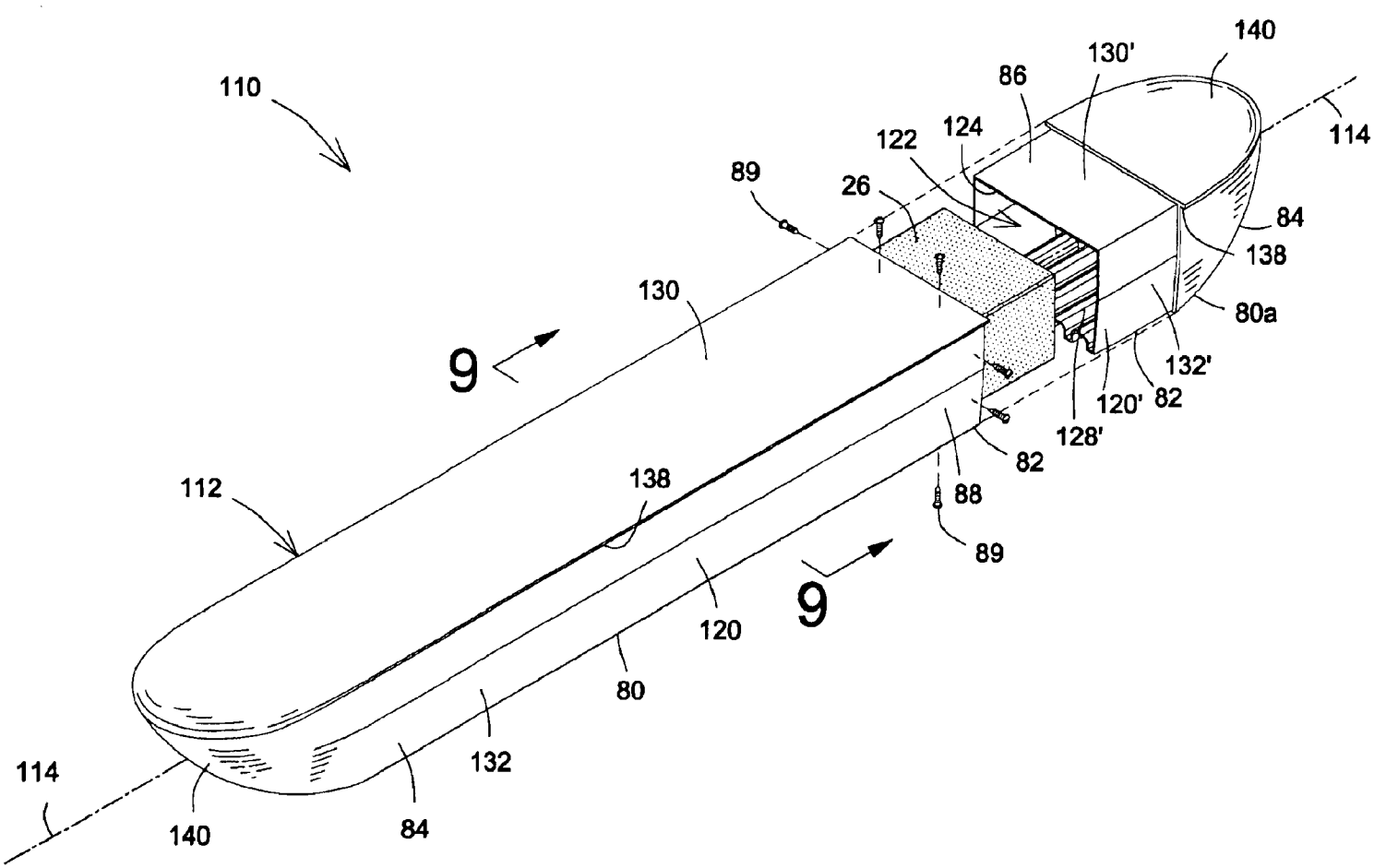
Figures 9, 10, 11:
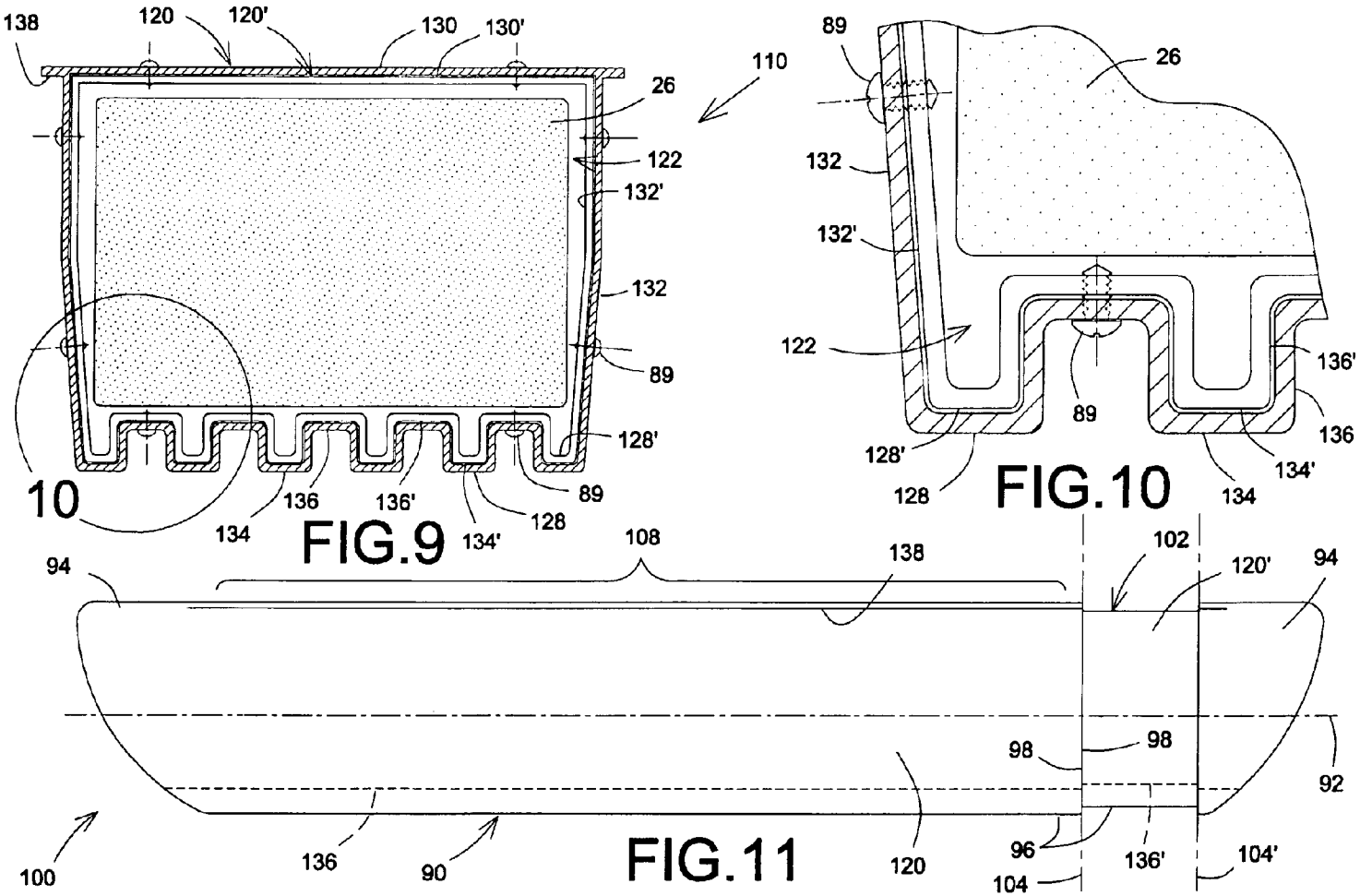
FIG. 9, in a transversal cross-sectional view taken along arrows 9—9 of FIG. 8, illustrates the cross-sectional configuration of the pontoon shown in FIG. 8.
FIG. 10, in a partially enlarged transversal cross-sectional view taken along line 10 of FIG. 9, illustrates more in details the interface between shell segments of FIG. 9.
FIG. 11, in a side elevational view, illustrates a shell manufactured using a rotational molding process for the fabrication of the embodiment of FIG. 8.

Referring now to FIGS. 8 to 10, there is shown a pontoon 110, in accordance with another embodiment of the present invention. The shell 112 of the pontoon 110 includes at least two generally elongated shell segments 80, 80*a* assembled together into an end-to-end configuration.

Similarly to the previous embodiment 10, each shell segment 80, 80*a* is made out of a generally rigid material and defines a pair of generally opposed segment longitudinal ends 82, 84, at least one of which is a segment connecting end 82. Each shell segment 80, 80*a* has a segment peripheral wall 120 surrounding a segment inner volume 122 and defines at least one end aperture 124 extending into the segment inner volume 122 from the segment connecting end 82. All shell segments 80, 80*a* connect to each other into an end-to-end configuration so as to form a generally elongated shell 112 with a shell longitudinal axis 114 that extends through all shell segments 80, 80*a*.

A filling component 26, made from a single or more pieces positioned within the segment inner volumes 122, is made out of a generally cohesive buoyant material. The filling component 26 is slidably and successively insertable through the end apertures 124 in a direction generally along the shell longitudinal axis 114 and towards corresponding opposed segment longitudinal end 84. The volume of the filling component 26 is such that the combination of the shell 112 and the filling component 26 forms a generally buoyant combination.

Typically, the adjacent shell segments 80, 80*a* are connected to each other with a male-female engagement in which a male segment connecting end 86 connects to an adjacent female segment connecting end 88.

The male segment connecting end 86 is typically formed by a longitudinal end portion of the segment peripheral wall 120 that has a circumferential periphery generally radially smaller than the remaining longitudinal portion of the segment peripheral wall 120 such that it is generally slidably connectable to a similar remaining longitudinal portion of the segment peripheral wall 120 of the adjacent shell segment 80 by at a least partially slidably fitting thereinto.

Typically, the female segment connecting end 88 simply is a "regular size" longitudinal end portion of the remaining longitudinal portion of the segment peripheral wall 120.

Typically, the longitudinal endmost shell segments 80, 80*a* include a closing component 140 mounted at least partially over the end aperture 124 for at least partially closing the end aperture 124.

As shown more specifically in FIGS. 9 and 10, the segment peripheral wall 120 includes a base section 128, a generally opposed supporting section 130 and a pair of spacing sections 132 that extend there between in a generally spaced apart relationship relative to each other. The base section 128 typically defines a base section outer surface 134 provided with at least one longitudinal channel 136 that extends substantially and at least partially there along. The supporting section 130 preferably defines at least one linking flange 138 that extends laterally there from in a direction leading generally adjacent from an adjacent spacing section 132.

Typically, the spacing sections 132 taper generally towards each other in a direction leading towards the base section 128.

The peripheral wall 120' of the male connecting end 86 also typically has a base section 128', a generally opposed supporting section 130' and a pair of spacing sections 132', with at least one longitudinal channel 136' that extends substantially and at least partially along an outer surface 134' of the base section 128'. The peripheral wall 120' of the male connecting end 86 has dimensions that allow its sliding insertion within the peripheral wall 120 of the shell segment 80. Conventional screw fasteners 89 are used to secure the two peripheral walls 120, 120' to each other. On the base section 128, the screws 89 are typically located inside the longitudinal channels 136.

Now referring to FIG. 11, there is shown a shell 100, preferably made through a rotational molding process, used for the fabrication of the above-described pontoon 110.

The shell 100 typically includes a generally elongated shell segment 90 made out of a generally rigid material such as thermoplastics, relatively thin metallic alloys or the like. The shell segment 90 that defines a shell longitudinal axis 92 and has a segment peripheral wall 120 that extends between a pair of generally opposed longitudinal segment closing ends 94 and surrounds a shell inner volume 122. The shell segment 90 is dividable in a direction generally transverse to the shell longitudinal axis 92 into at least two longitudinal sections 96 with a respective end aperture 98 that extends into the respective shell inner volume 122 to allow the latter to be at least partially fillable by a filling component 26.

Although not necessary, the shell segment 90 typically includes a longitudinal throat section 102 located intermediate the segment closing ends 94. The throat peripheral wall 120' has a circumferential periphery generally radially smaller than the periphery of the segment peripheral wall 120. More specifically, the throat peripheral wall 120' is configured and sized to be longitudinally and slidably fittable into the shell inner volume 122 of the shell segment 90.

Preferably, the throat section 102 extends longitudinally inwardly (in the axial direction) from one of the longitudinal segment closing ends 94.

Typically, the shell segment 90 defines a first predetermined transversal dividing region 104 (identified by section line) at an interface between the throat section 102 and a remaining portion of the shell segment 90, as shown in FIG. 11.

Preferably, a second predetermined transversal dividing region 104' (identified by section line in FIG. 11) is defined at an interface between the throat section 102 and the adjacent segment closing end 94. As it would be obvious to one skilled in the art, the throat section 102 could also be transversally cut anywhere in-between the first and second predetermined dividing regions 104, 104' without departing from the scope of the present invention.

By dividing or cutting the shell segment 90 only at the first predetermined dividing region 104, the throat section 102, still integral with a longitudinal segment closing end 94 of one of the longitudinal sections 96, is slidably inserted into the end aperture 98 formed in the other longitudinal section 96 of the shell segment 90 such that the two parts or sections 96 could be secured to each other using screws 89 as illustrated in FIG. 8.

Additionally, after the shell 100 has been divided at either or both first and second predetermined dividing locations 104, 104', the elongate shell segment 90 could be further divided at any location to size it in length within the region identified as 108 in FIG. 11 according to the needs of the user, with or without the integral segment closing end 94.

At least one of the segment closing ends 94, preferably both have a generally hydrodynamically convex configuration as detailed hereinabove.

Preferably, the throat section 102 remains integral with one of the two shell longitudinal sections 96, depending on the required end configuration of the pontoon 110.

Figure 12:
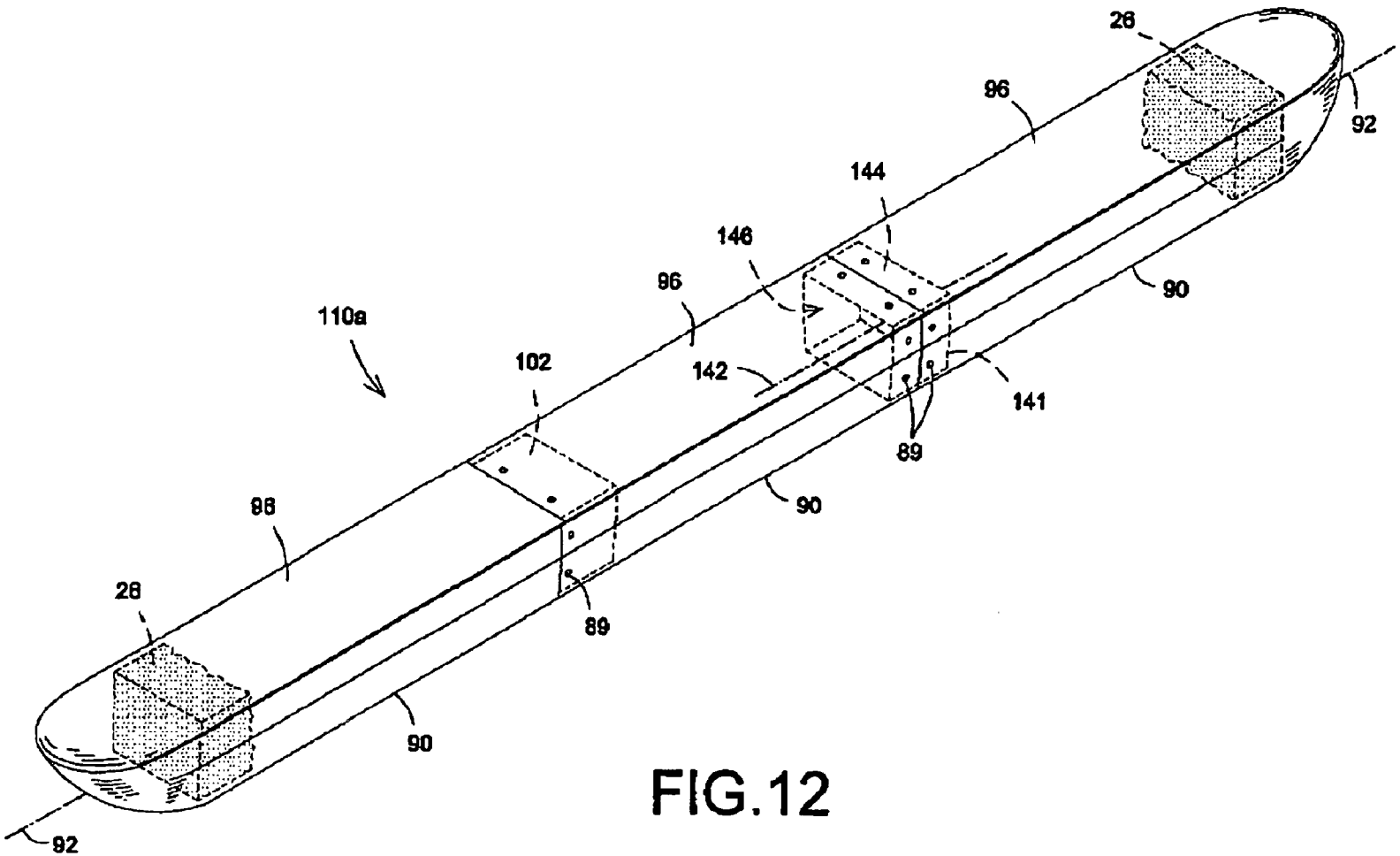
FIG. 12, in a perspective view, illustrates a pontoon in accordance with another embodiment of the present invention three shell segments obtained from three shells as shown in FIG. 11 assembled together.

As shown in FIG. 12, a pontoon 110*a* includes three main shell segments 90, at least partially filled with filling component (not shown), all obtained from three different shells 100 as illustrated in FIG. 11 made from a same mold.

Alternatively, the pontoon 110*a* further includes a connecting component 140 that connects adjacent shell segments 90 to one another.

Typically, the connecting component 141 is the throat section 102 of the shell 100 separated from both segment closing ends 94 such as when the shell 100 is divided at both first and second predetermined dividing regions 104, 104'. Such a typical connecting component 141 is shown in dotted lines in FIG. 12 connecting the last two shell segments 90 on the right hand side of the Figure.

Preferably, the connecting component 141 defines a connector longitudinal axis 142 and has a connector peripheral wall 144 surrounding a connector inner volume 146 that extends longitudinally there through. The connector inner volume 146 is generally in fluid communication with the segment inner volumes 122 of the adjacent shell segments 90 such that the filling component 26 is slidably and successively insertable through the connector inner volume 146 and the adjacent segment inner volumes 122 in a direction generally along the connector longitudinal axis 142 and the shell longitudinal axis 92, which are preferably generally coaxial to one another.

As it is for the throat section 102, the connector peripheral wall 144 is configured and sized to longitudinally slidably fit into the segment inner volume 122 of the adjacent shell segments 90.

Accordingly, the connector peripheral wall 144 has a circumferential periphery generally radially smaller than the periphery of the segment peripheral wall 120 of adjacent shell segments 90 so as to longitudinally slidably fit thereinto.

Obviously, one skilled in the art would easily understand that the connector component 141 could include a plurality of connecting bars or brackets (not shown) securing to the peripheral walls 120 of adjacent shell segments 90 without departing from the scope of the present invention. Further, it would also be obvious to one skilled in the art that the presence of a filling component 26 inside the shell segments 90, especially when extending through the interfaces between adjacent shell segments 90, increases the overall rigidity of the pontoon 110*a*.

Although the present pontoon with shell therefor has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A pontoon, said pontoon comprising:

a plurality of generally elongated shell segments, each said shell segment being made out of a generally rigid material, each said shell segment defining a pair of generally opposed segment longitudinal ends, at least one of said segment longitudinal ends being a segment connecting end; each said shell segment having a segment peripheral wall surrounding a segment inner volume and defining at least one end aperture extending into said segment inner volume from said segment connecting end, said plurality of shell segments connecting to each other with a male-female engagement into an end-to-end configuration so as to form a generally elongated shell, said shell defining a shell longitudinal axis extending through said plurality of shell segments, said male-female engagement including a male segment connecting end connectable to an adjacent female segment connecting end, said female segment connecting end being a longitudinal end portion of said segment peripheral wall;

a filling component positioned within said segment inner volumes, said filling component being made out of a generally buoyant material, said filling component being slidably and successively insertable through said at least one end apertures in a direction generally along said shell longitudinal axis and towards corresponding said opposed segment longitudinal end, the volume of said filling component being such that the combination of said shell and said filling component forms a generally buoyant combination.

2. A pontoon as recited in claim 1, wherein said male segment connecting end is formed by a throat section located at a longitudinal end portion of said segment peripheral wall.

3. A pontoon as recited in claim 2, wherein said male segment connecting end is connectable to said adjacent female segment connecting end with a longitudinal sliding engagement.

4. A pontoon as recited in claim 1, further comprising a closing component mounted at least partially over said at least one end aperture of an end one of said shell segments for at feast partially closing said at least one end aperture of said end one of said shell segments.

5. A pontoon as recited in claim 1, wherein said segment peripheral wall includes a base section, a generally opposed supporting section and a pair of spacing sections extending therebetween in a generally spaced apart relationship relative to each other; said base section defining a base section outer surface, said base section outer surface being provided with at least one longitudinal channel extending substantially and at least partially therealong.

6. A pontoon as recited in claim 1, wherein said segment peripheral wall includes a base section, a generally opposed supporting section and a pair of spacing sections extending therebetween in a generally spaced apart relationship relative to each other, said supporting section defining at least one longitudinal linking flange extending laterally therefrom in a direction leading generally adjacent from an adjacent spacing section.

7. A pontoon as recited in claim 6, wherein said spacing sections taper generally towards each other in a direction leading towards said base section.

8. A pontoon as recited in claim 1, wherein said segment inner volume defines a generally hollow ballast section extending at least partially longitudinally therealong; whereby said ballast section is at least partially fillable with a ballast material.

9. A pontoon as recited in claim 1, further comprising an end cap, said end cap including a cap wall for generally overriding said at least one end aperture of a longitudinal endmost of said shell segments.

10. A pontoon as recited in claim 9, wherein said end cap further includes a cap flange extending from said cap wall for attaching said cap wall to said longitudinal endmost of said shell segments.

11. A pontoon as recited in claim 9, further comprising a cap valve extending through said cap wall for selectively establishing a fluid communication between said segment inner volumes and the exterior of said shell.

12. A pontoon as recited in claim 10, wherein said cap flange is inserted into said segment inner volume between said longitudinal endmost of said shell segments and said filling component.

13. A pontoon as recited in claim 1, further comprising a valve extending between one of said segment inners volume and the exterior of said shell for selectively establishing a fluid communication between said segment inner volumes and the exterior of said shell.

14. A pontoon as recited in claim 1, further comprising a connecting component connecting said female segment connecting ends of adjacent shell segments to one another, said connecting component at least partially filling said segment inner volumes adjacent said segment peripheral walls at said female segment connecting ends.

15. A pontoon as recited in claim 14, wherein said connecting component defines a connector longitudinal axis, said connecting component having a connector peripheral wall surrounding a connector inner volume extending longitudinally therethrough, said connector inner volume being in fluid communication with said segment inner volumes of adjacent said shell segments, whereby said filling component is slidably and successively insertable through said connector inner volume and said adjacent segment inner volumes in a direction generally along said connector longitudinal axis and shell longitudinal axis, respectively.

16. A pontoon as recited in claim 15, wherein said connector peripheral wall is configured and sized to longitudinally slidably fit into said segment inner volume of adjacent said shell segments.

17. A pontoon as recited in claim 16, wherein said connector peripheral wall has a periphery generally smaller than the periphery of said segment peripheral wall of adjacent said shell segments so as to longitudinally slidably fit thereinto.

18. A shell for pontoon, said shell comprising:

a generally elongated shell segment being made out of a generally rigid material, said shell segment defining a shell longitudinal axis, said shell segment having a segment peripheral wail extending between a pair of generally opposed longitudinal segment closing ends and surrounding a shell inner volume, said shell segment having a longitudinal throat section located intermediate said segment closing ends, said shell segment being dividable in a direction generally transverse to said shell longitudinal axis at a location adjacent said throat section into at least two longitudinal sections with a respective end aperture extending into respective said shell inner volume so as to allow said shell inner volumes to be at least partially fillable by a filling component.

19. A shell as recited in claim 18, wherein said segment peripheral wall of said throat section is configured and sized to be longitudinally and slidably fittable into said shell inner volume of a remaining section of said shell segment.

20. A shell as recited in claim 19, wherein said throat section extends longitudinally inwardly from one of said longitudinal segment closing ends.

21. A shell as recited in claim 20, wherein said shell segment defines a first predetermined transversal dividing region at an interface between said throat section and a remaining portion of said shell segment.

22. A shell as recited in claim 21, wherein said shell segment defines a second predetermined transversal dividing region at an interface between said throat section and said one of said longitudinal segment closing ends.

23. A shell as recited in claim 18, wherein said segment peripheral wall includes a base section, a generally opposed supporting section and a pair of spacing sections extending therebetween in a generally spaced apart relationship relative to each other; said base section defining a base section outer surface, said base section outer surface being provided with at least one longitudinal channel extending substantially and at least partially therealong.

24. A shell as recited in claim 18, wherein said segment peripheral wall includes a base section, a generally opposed supporting section and a pair of spacing sections extending therebetween in a generally spaced apart relationship relative to each other; said supporting section defining at least one longitudinal linking flange extending laterally therefrom in a direction leading generally adjacent from an adjacent spacing section.

25. A shell as recited in claim 24, wherein said spacing sections taper generally towards each other in a direction leading towards said base section.

26. A shell as recited in claim 18, wherein said shell is manufactured using a rotational molding process.

27. A shell as recited in claim 18, wherein at least one of said generally opposed longitudinal segment closing ends has a generally hydrodynamically convex configuration.

* * * * *